US008515653B2

(12) United States Patent
Yoshikawa et al.

(10) Patent No.: US 8,515,653 B2
(45) Date of Patent: Aug. 20, 2013

(54) DRIVE CONTROL METHOD OF FLOW RATE CONTROL VALVE IN COMMON RAIL TYPE FUEL INJECTION CONTROL APPARATUS AND COMMON RAIL TYPE FUEL INJECTION CONTROL APPARATUS

(75) Inventors: Hiroshi Yoshikawa, Saitama (JP); Shoko Tanida, Saitama (JP)

(73) Assignee: Bosch Corporation, Tokyo (JP)

( * ) Notice: Subject to any disclaimer, the term of this patent is extended or adjusted under 35 U.S.C. 154(b) by 600 days.

(21) Appl. No.: 12/747,732

(22) PCT Filed: Dec. 10, 2008

(86) PCT No.: PCT/JP2008/072365

§ 371 (c)(1),
(2), (4) Date: Jun. 11, 2010

(87) PCT Pub. No.: WO2009/075276

PCT Pub. Date: Jun. 18, 2009

(65) Prior Publication Data

US 2010/0282213 A1 Nov. 11, 2010

(30) Foreign Application Priority Data

Dec. 11, 2007 (JP) ..... 2007-319928

(51) Int. Cl.
*F02D 41/20* (2006.01)

(52) U.S. Cl.
USPC ..... 701/113; 123/456; 123/491; 123/478

(58) Field of Classification Search
USPC ..... 123/456, 472, 478, 491; 701/103–105, 701/113
See application file for complete search history.

(56) References Cited

U.S. PATENT DOCUMENTS

| | | | | |
|---|---|---|---|---|
| 4,770,140 | A | 9/1988 | Kiuchi et al. | |
| 5,957,095 | A | 9/1999 | Kako | |
| 7,273,038 | B2 * | 9/2007 | Hayakawa | 123/478 |
| 2005/0103312 | A1 | 5/2005 | Uchiyama | |
| 2007/0044763 | A1 | 3/2007 | Ohshima | |

FOREIGN PATENT DOCUMENTS

| | | | |
|---|---|---|---|
| DE | 102008000513 | | 10/2008 |
| JP | 6293456 | A | 4/1987 |
| JP | 10103090 | A | 4/1998 |
| JP | 11132064 | A | 5/1999 |
| JP | 2005147090 | | 6/2005 |
| JP | 3851140 | B2 | 11/2006 |
| JP | 200792655 | A | 4/2007 |

* cited by examiner

*Primary Examiner* — Hai Huynh
(74) *Attorney, Agent, or Firm* — Michael Best & Friedrich LLP

(57) ABSTRACT

A drive control method of a flow rate control valve in a common rail type fuel injection control apparatus, in which an integral value of a difference between a target current and an actual current is used in feedback control of an energization current of the flow rate control valve such that the actual current of the flow rate control valve becomes closer to the target current, the flow rate control valve controlling an amount of fuel supplied to a high pressure pump that pressure feeds high pressure fuel to a common rail.

4 Claims, 5 Drawing Sheets

DRIVE CONTROL METHOD OF FLOW RATE CONTROL VALVE IN COMMON RAIL TYPE FUEL INJECTION CONTROL APPARATUS AND COMMON RAIL TYPE FUEL INJECTION CONTROL APPARATUS

BACKGROUND OF THE INVENTION

1. Field of the Invention

The present invention relates to a drive control method of a flow rate control valve used in a common rail type fuel injection control apparatus, and it particularly relates to a drive control method in which stability and responsiveness of a rail pressure control etc. are improved.

2. Description of the Related Art

A so-called common rail type fuel injection control apparatus is a known apparatus, as disclosed, for example, in Japan Patent No. 385114, that pressurizes fuel by a high pressure pump, pressure feeds the fuel to a common rail that accumulates pressure as an accumulator, and supplies the accumulated highly pressurized fuel to an injector. Thus, it is possible to inject the highly pressurized fuel to an engine by the injector.

In the high pressure pump of the common rail type fuel injection control apparatus, as means for controlling a flow rate of fuel to a high pressure plunger, an electromagnetic proportional control valve is used as a flow rate control valve.

It is common that this flow rate control valve adjusts a valve is opening degree by changing an amount of energization through a so-called duty ratio control that changes a pulse width of a pulse current of a constant repetition frequency. Then, the duty ratio is computed or calculated by a predetermined arithmetic expression, map etc. based on, for example, the difference between an actual rail pressure and a target rail pressure, an actual value of a current that flows to the flow rate control valve etc.

Note that, individual electrical characteristics of the flow rate control valve may easily vary depending on the way in which individual electromagnetic coils are wound etc., and the variations may cause variations of an energization current. From the perspective of reducing as much as possible the influence from such variations of the individual electrical characteristics, an integration control is used in parallel to control the energization current of the flow rate control valve.

Namely, in a known apparatus, the duty ratio of the pulse applied to the flow rate control valve is basically expressed as a percentile of the product of a target current of the flow rate control valve and a standard resistance value of the flow rate control valve divided by a vehicle battery voltage.

In other words, the duty ratio is expressed as duty ratio=target current×standard resistance value÷battery voltage×100%.

However, since an actual resistance value of the flow rate control valve changes in accordance with a temperature, a difference arises between the actual value and the standard value, and as a result, a difference is generated between an actual current and a target current. Therefore, from the perspective of making the actual current closer to the target current, regardless of such temperature changes of the resistance value of the flow rate control valve, an integral term that is calculated by successively integrating differences between the actual current and target current of the flow rate control valve is taken into account in the process of calculating the duty ratio as described below.

Duty ratio=target current×standard resistance value×100%×integral term÷battery voltage Here, integral term=last integral term+integral gain×(target current−actual current).

Integral processing is taken into account in this way to control the energization current in known art also, as disclosed, for example, in JP-A-9-72453, such that the energization current of the electromagnetic proportional control valve can be controlled accurately.

However, in the known fuel injection control apparatus, a value calculated as the resistance value of the flow rate control valve is used as an initial value of the above-described integral term, the resistance value being estimated using an equation, namely, the initial value of the integral term=standard resistance value of the flow rate control valve÷fuel temperature. However, since the fuel temperature does not necessarily match a temperature of the flow rate control valve, it takes time for the actual current of the flow rate control valve to reach the target current. As a result, a problem arises in which stability and responsiveness of a rail pressure control deteriorates.

Namely, when a vehicle is operated for a sufficient period of time, it is not unreasonable to assume that the fuel temperature usually matches the temperature of the flow rate control valve. However, for example, when a vehicle is left for a long time with an ignition switch turned on and without activating a starter, and then the starter is reactivated after once turning off the ignition switch, as the flow rate control valve is energized even in a state in which the starter is not activated, the flow rate control valve is in a high temperature state, while the fuel temperature remains low. It is thus difficult to use the fuel temperature to estimate the resistance value of the flow rate control valve.

SUMMARY OF THE INVENTION

This invention has been made in view of the above-mentioned circumstances and provides a drive control method of a flow rate control valve in a common rail type fuel injection control apparatus and the common rail type fuel injection control apparatus that can appropriately control the energization current of the flow rate control valve and also can improve the stability and responsiveness of the rail pressure control, without changing a basic control method in known art that uses the fuel temperature to estimate the resistance value of the flow rate control valve, even when it is unreasonable to assume that the fuel temperature matches the temperature of the flow rate control valve.

According to a first aspect of the present invention, there is provided a drive control method of a flow rate control valve in a common rail type fuel injection control apparatus, in which an integral value of a difference between a target current and an actual current is used in feedback control of an energization current of the flow rate control valve such that the actual current of the flow rate control valve becomes closer to the target current, the flow rate control valve controlling an amount of fuel supplied to a high pressure pump that pressure feeds high pressure fuel to a common rail, the drive control method being characterized in that when an ignition switch is turned on, an initial value in an integral calculation that calculates the integral value of the difference between the target current and the actual current is set to a predetermined value to supply the target current at that time point to the flow rate control valve; and a second integral gain that is larger than a first integral gain that is used under normal conditions is set as an integral gain in the integral calculation during a predetermined time period after the ignition switch is turned on, while the first integral gain is set as the integral gain after the predetermined time period elapses.

According to a second aspect of the present invention, there is provided a common rail type fuel injection control apparatus that comprises a high pressure pump that pressure feeds fuel to a common rail, a flow rate control valve that controls an amount of fuel supply to the high pressure pump, and an electronic control unit, wherein the electronic control unit uses an integral value of a difference between a target current and an actual current of the flow rate control valve in feedback control of the flow rate control valve such that the actual current of the flow rate control valve becomes closer to the target current, the common rail type fuel injection control apparatus being characterized in that the electronic control unit is structured such that: when an ignition switch is turned on, an initial value in an integral calculation that calculates the integral value of the difference between the target current and the actual current is set to a predetermined value to supply the target current at that time point to the flow rate control valve; and a second integral gain that is larger than a first integral gain, which is used under normal conditions, is set as an integral gain in the integral calculation during a predetermined time period after the ignition switch is turned on, while the first integral gain is set as the integral gain and the integral calculation is performed after the predetermined time period elapses.

BRIEF DESCRIPTION OF THE DRAWINGS

FIG. 4 is a schematic diagram schematically showing a change in the integral gain as time elapses after an ignition switch is turned on; and FIG. 5 is a schematic diagram schematically showing a change in the target current and the actual current of the flow rate control valve after a time point when the ignition switch is turned on.

DETAILED DESCRIPTION OF THE PREFERRED EMBODIMENTS

An embodiment of the invention will be described below while referring to FIG. 1 to FIG. 5.

It will be noted that the members and arrangements described below are not intended to limit the present invention and can be variously modified within the scope of the gist of the present invention.

Figure 1:
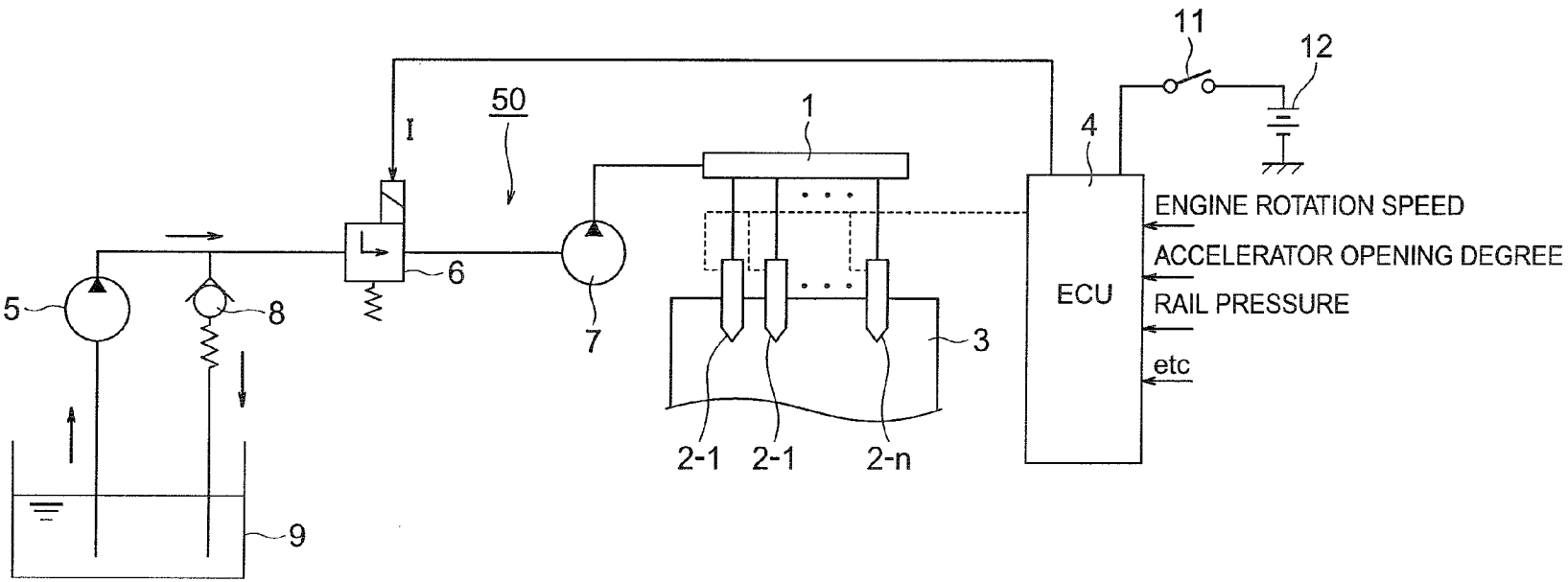
FIG. 1 is a structural diagram showing an example of the structure of a common rail type fuel injection control apparatus to which a drive control method of a flow rate control valve according to an embodiment of the invention is applied.

First, an example of the structure of a common rail type fuel injection control apparatus, to which a drive control method of a flow rate control valve according to the embodiment of the invention is applied, is described with reference to FIG. 1.

The main structural elements of the common rail type fuel injection control apparatus are a high pressure pump device 50 that pressure feeds high pressure fuel, a common rail 1 that accumulates the high pressure fuel pressure fed by the high pressure pump device 50, a plurality of fuel injection valves 2-1 to **2-*n* that inject and supply the high pressure fuel supplied from the common rail 1 to cylinders of a diesel engine (hereinafter referred to as "engine") 3, and an electronic control unit (shown as "ECU" in FIG. 1) 4** that performs a fuel injection control etc. The structure itself is substantially the same as a basic structure of this type of a well-known fuel injection control apparatus.

The high pressure pump device 50 has a known structure whose main structural elements are a supply pump 5, a flow rate control valve 6, and a high pressure pump 7.

In the structure, fuel inside a fuel tank 9 is pumped up by the supply pump 5 and supplied to the high pressure pump 7 via the flow rate control valve 6.

Here, an electromagnetic proportional control valve is used for the flow rate control valve 6, and by controlling its energization amount using the electronic control unit 4, a flow rate of fuel to the high pressure pump 7, in other words, a discharge rate of the high pressure pump 7, is adjusted.

Note that a return valve 8 is provided between an output side of the supply pump 5 and the fuel tank 9, and excess fuel on the output side of the supply pump 5 can be returned to the fuel tank 9.

The fuel injection valves 2-1 to **2-*n* are respectively provided for each cylinder of the diesel engine 3. The high pressure fuel is supplied from the common rail 1 to each of the fuel injection valves 2-1 to 2-*n*, and the fuel injection is performed while the injection is controlled by the electronic control unit 4**.

The electronic control unit 4 includes, for example, a micro computer (not shown in the figures) as a central element, which has a known structure, and a memory element (not shown in the figures) such as a RAM, a ROM etc., while also having, as its main structural elements, a drive circuit (not shown in the figures) that drives the fuel injection valves 2-1 to **2-*n* and an energization circuit (not shown in the figures) that energizes the flow rate control valve 6**.

To control an operation of the engine 3 etc., an engine rotation speed, an accelerator opening degree, an actual rail pressure of the common rail 1 etc. are externally input to the electronic control unit 4 via a sensor that is not shown in the figures.

Note that a voltage of a vehicle battery 12 is applied to the electronic control unit 4 via an ignition switch 11, and inside the electronic control unit 4, a required voltage outside the voltage of the vehicle battery 12 is generated based on the voltage of the vehicle battery 12.

Figure 2:
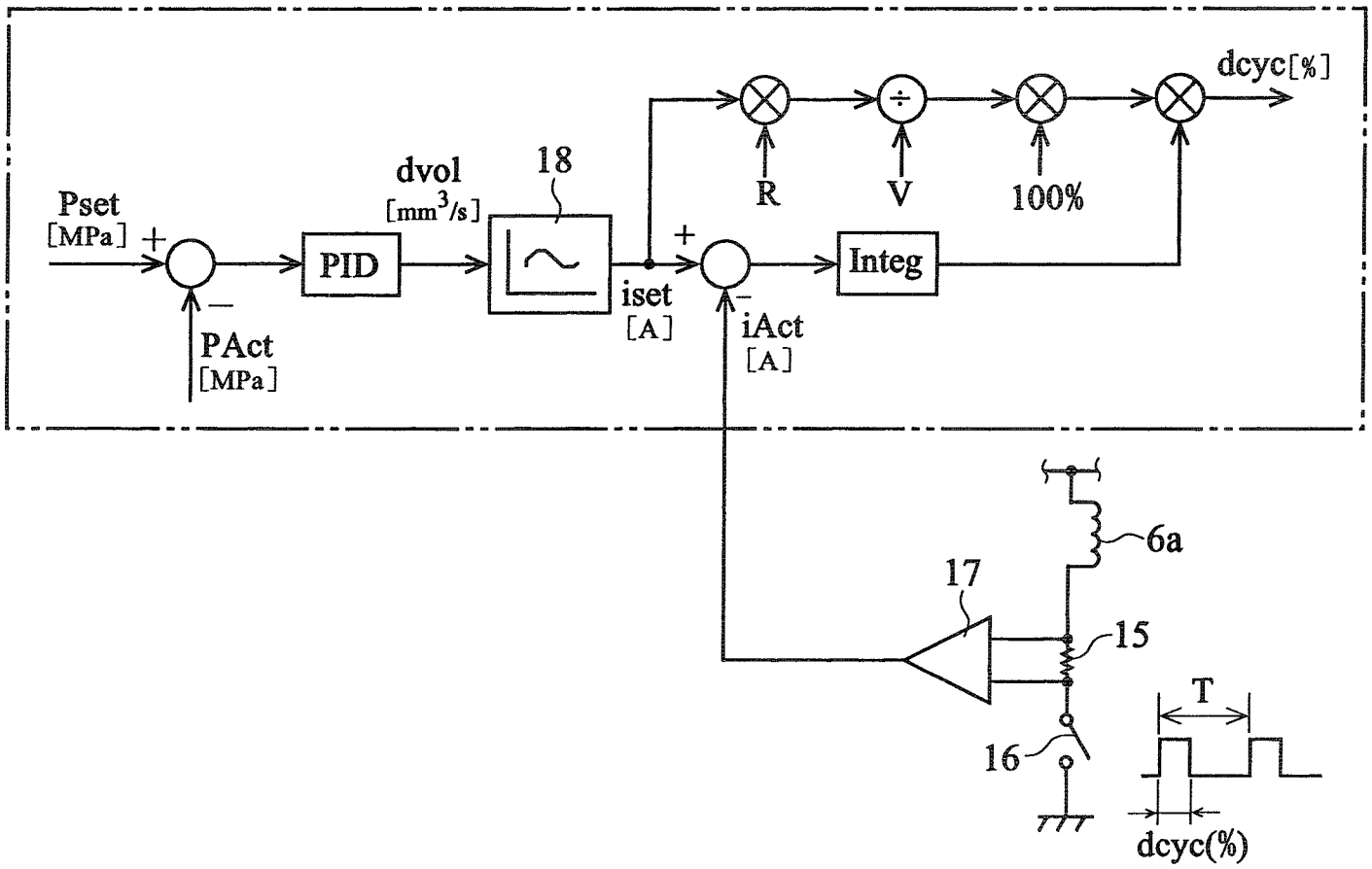
FIG. 2 is a functional block diagram illustrating the content of determination processing of a duty ratio of the flow rate control valve, the determination processing being performed by an electronic control unit that constitutes the common rail type fuel injection control apparatus shown in FIG. 1.

FIG. 2 shows a functional block diagram that illustrates the content of determination processing of a duty ratio. The determination processing is performed in the drive control of the flow rate control valve 6 that is performed by the above-described electronic control unit 4. The content is described below with reference to FIG. 2.

First, the flow rate control valve 6 according to the embodiment of the invention is a known electromagnetic proportional control valve whose valve opening degree can be changed in accordance with the energization amount. The energization amount is adjusted in substantially the same way as in known art by so-called duty ratio control that changes a pulse width of a pulse current of a constant repetition frequency.

In FIG. 2, a section enclosed by an alternate long and two short dashes line particularly shows a functional block that illustrates the content of the duty ratio determination processing that is performed by software processing in the electronic control unit 4.

Further, in FIG. 2, the drive circuit (energization circuit) of the flow rate control valve 6 is shown by an equivalent circuit. Namely, an electromagnetic coil 6*a* of the flow rate control valve 6 is provided between a power source that is not shown in the figures and a ground, and it is connected in series with an electric current detection resistor 15 and a switching element 16, from the power source side in the order of the electromagnetic coil 6*a*, the electric current detection resistor 15 and the switching element 16.

Further, a voltage at both ends of the electric current detection resistor 15 is fed back to the electronic control unit 4 as an actual current iAct that actually flows to the flow rate control valve 6 via an operational amplifier 17, and the voltage is then provided for the duty ratio determination processing that will be described below.

In concrete terms, a semiconductor element such as a MOS transistor is used for the switching element 16, and its conduction and non-conduction is controlled by the electronic control unit 4. A conduction time corresponds to a duty ratio dcyc (%) that is determined by the electronic control unit 4 as described below.

A determination of the duty ratio dcyc (%) that is performed by the electronic control unit 4 is specifically described below with reference to FIG. 2.

First, a difference between a target rail pressure Pset and an actual rail pressure PAct that are input into the electronic control unit 4, namely, a rail pressure difference=Pset−PAct is calculated. Here, the target rail pressure is calculated by performing a program (not shown in the figures) that is performed by the electronic control unit 4 to calculate the target rail pressure based on the engine rotation speed, the accelerator opening degree, the actual rail pressure etc.

Then, PID control is performed with respect to the difference between the calculated target rail pressure Pset and the actual rail pressure PAct, and a result of the control is converted into an amount of fuel that is supplied to the high pressure pump 7 via the flow rate control valve 6, in other words, a flow rate dvol ($mm^3/s$) of the flow rate control valve 6.

Next, a target current iset, which should be supplied to the flow rate control valve 6 in accordance with the above-mentioned flow rate dvol of the flow rate control valve 6, is calculated by a predetermined electric current calculation map 18 that is stored in a memory area (not shown in the figures) of the electronic control unit 4.

Then, integral processing (shown as "Integ" in FIG. 2) is performed on a difference between the target current iset and the actual current iAct. Namely, as shown in an Expression 1 below, every time the difference between the target current iset and the actual current iAct is calculated, the difference is multiplied by an integral gain, the multiplication result is integrated, and as a result, an integral value I(n+1) of the difference between the target current iset and the actual current iAct is calculated.

$$I(n+1)=I(n)+K(i\text{set}-i\text{Act}) \qquad \text{Expression 1}$$

Here, K is the integral gain, and in known art, a predetermined constant is always used. In contrast to this, in the embodiment of the invention, the integral gain is caused to change under a predetermined condition described below.

Further, I(n) is an integral value that is calculated by the last calculation (hereinafter "I(n)" is referred to as "last integral value").

On the other hand, separately from the above-described arithmetic processing of the difference between the target current iset and the actual current iAct, the product of the target current iset and a predetermined standard resistance value R of the flow rate control valve 6 is calculated. Then, the multiplication result is divided by a power source voltage V that is used to energize the flow rate control valve 6, and the product of the division result, the calculation result of the above-described Expression 1, and 100% is calculated. Then, the multiplication result is determined as the duty ratio dcyc (%).

Note that, in concrete terms, the power source voltage V is a voltage of the vehicle battery 12.

Figure 3:
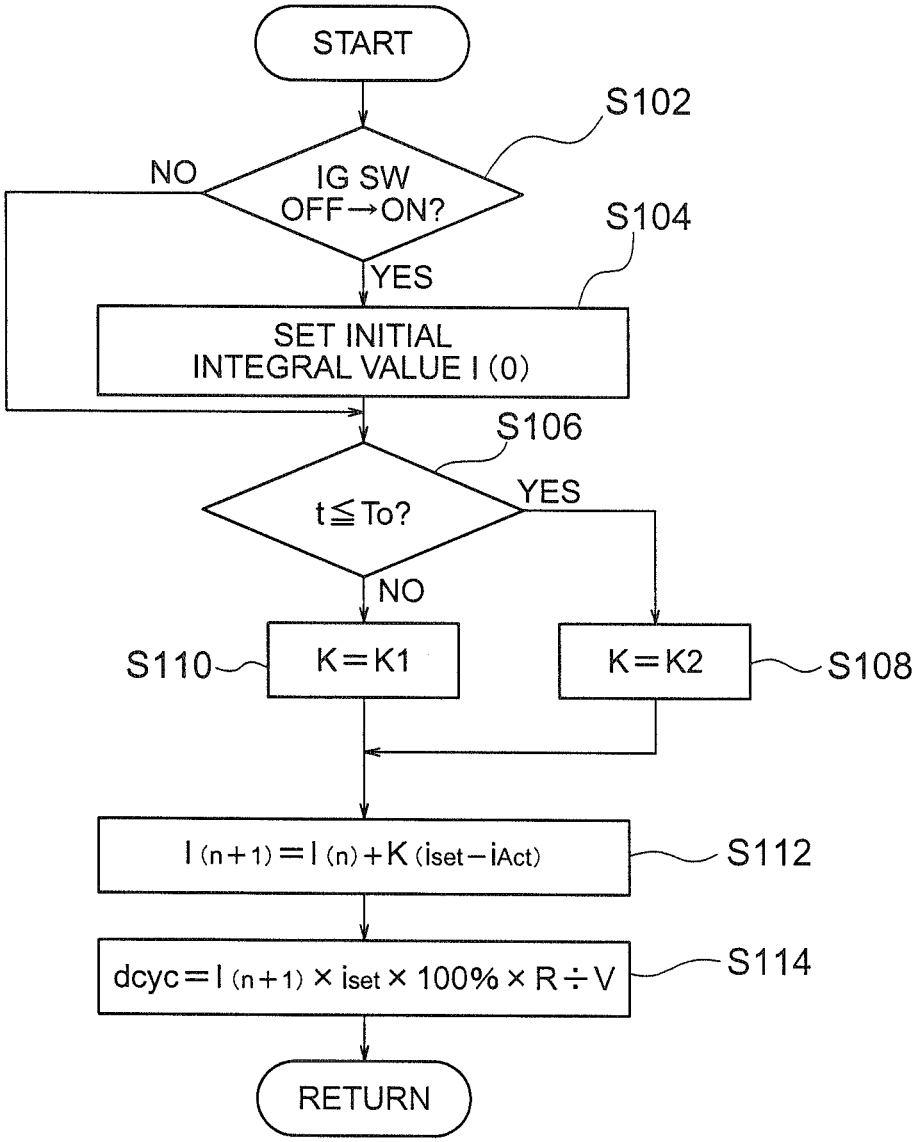
FIG. 3 is a subroutine flow chart showing a procedure for determining an integral gain in integral processing of a difference between a target current and an actual current of the flow rate control valve, the integral processing being performed in the determination processing of the duty ratio of the flow rate control valve.

FIG. 3 is a subroutine flow chart that illustrates a procedure for determining the integral gain for the integral processing in which the integral value of the difference between the target current iset and the actual current iAct is calculated. The content of the procedure is described below with reference to FIG. 3.

After the processing is started, first, it is determined whether or not the ignition switch 11 has just been turned on from the off state (refer to step S102 in FIG. 3). Then, at step S102, if it is determined that the ignition switch 11 has just been turned on from the off state (when YES), an initial value I(0) of the integral value is set to a predetermined value (refer to step S104 in FIG. 3), and the process advances to step S106 described below. On the other hand, at step S102, if it is determined that the ignition switch 11 has not just been turned on from the off state (when NO), namely, when this step S102 is not performed for the first time after the ignition switch 11 is turned on from the off state, the process directly advances to step S106 described below.

At step S106, it is determined whether or not an elapsed time period t after the ignition switch 11 is turned on is less than or equal to a predetermined time period To (refer to step S106 in FIG. 3).

At step S106, when it is determined that the elapsed time period t after the ignition switch 11 is turned on is less than or equal to the predetermined time period To (when YES), an integral gain K is set as K2 (a second integral gain) (refer to step S108 in FIG. 3). On the other hand, when it is determined that the elapsed time period t is not less than or equal to the predetermined time period To (when NO), namely, when the elapsed time period t exceeds the predetermined time period To, the integral gain K is set to a first integral gain K1 (K2>K1) (refer to step S110 in FIG. 3 and FIG. 4).

Figure 4:
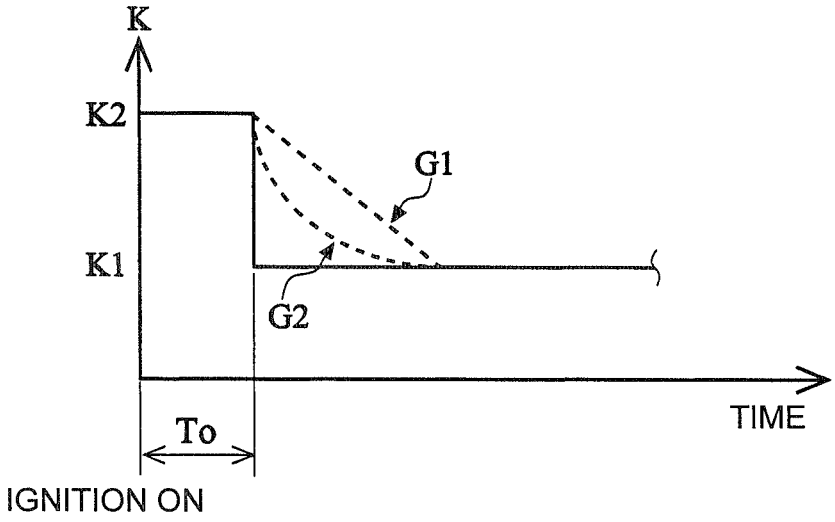

Note that FIG. 4 is a schematic diagram that schematically shows a change in the integral gain as time elapses after the ignition switch 11 is turned on.

Next, the integral value of the difference between the target current iset and the actual current iAct is calculated using the above-described Expression 1 (refer to step S112 in FIG. 3). Here, while K2 is used as K when the elapsed time period after the ignition switch 11 is turned on is less than or equal to the predetermined time period To, K1 is used as K when the elapsed time period after the ignition switch 11 is turned on exceeds the predetermined time period To.

Further, when the calculation of the integral value at step S112 is the first calculation immediately after the ignition switch 11 is turned on from the off state, the predetermined value set at the above-described step S104 is used for the last integral value I(n) as the initial value I(0).

Here, in known art, the initial value of the last integral value I(0) is calculated by dividing the standard resistance value of the flow rate control valve 6 by an estimated resistance value of the flow rate control valve 6 that is calculated from a fuel temperature using a predetermined arithmetic expression.

The reasons why the fuel temperature is used in this way to calculate the estimated resistance value of the flow rate control valve 6 are as described below.

Namely, under normal conditions, when the estimated resistance value of the flow rate control valve 6 is calculated, it is preferable that it is calculated based on a temperature of the flow rate control valve 6. However, since there is no room for installing a specialized sensor due to a lack of space for arranging components in the vehicle, limitations on the type of electronic circuit that can be installed, device price etc., the fuel temperature is alternatively used to calculate the estimated resistance value of the flow rate control valve 6.

Note that, when the vehicle is operated for a sufficient time period, it is not unreasonable to assume that the fuel temperature usually matches the temperature of the flow rate control valve. However, for example, when the vehicle is left for a long time with the ignition switch 11 turned on and without activating a starter (not shown in the figures), and then the starter is reactivated after once turning off the ignition switch 11, since the flow rate control valve 6 is energized even in a state in which the starter is not activated, the flow rate control valve 6 is in a high temperature state, while the fuel temperature remains low. Therefore, in this kind of case, the resistance value of the flow rate control valve 6 that is estimated using the fuel temperature is not significant, and as a matter of course, it is not appropriate to use the value as the initial value of the integral value that is calculated using the above-described Expression 1.

Therefore, in known art, there are cases in which an inappropriate initial value is set, and in this kind of case, there is a possibility that it will take time for the integral value to be stabilized, and as a result stability and responsiveness of the rail pressure control are compromised.

In contrast to this, in the embodiment of the invention, while taking into account the above-described case in which a non-negligible gap arises between the fuel temperature and the temperature of the flow rate control valve 6, the initial value I(0) of the integral value is set to a value selected irrespective of the fuel temperature and the temperature of the flow rate control valve 6. As described above, even in the above-described case, the initial value I(0) of the integral value is set to an appropriate value for the integral value to be stabilized promptly, while the integral gain is set to a larger value than that of normal conditions during a predetermined time period after the ignition switch 11 is turned on. Note that, in concrete terms, in the embodiment of the invention, "1" is used as the initial value of the integral value.

As described above, after the integral value is calculated at step S112, the duty ratio dcyc is calculated using an Expression 2 described below, and the process temporarily returns to a main routine that is not shown in the figures (refer to step S114 in FIG. 3).

$$dcyc(\%)=I(n+1)\times iset\times 100\%\times R\div V \qquad \text{Expression 2}$$

Here, as described above, iset is the target current with which the flow rate control valve 6 should be energized, V is, as illustrated above in FIG. 2, the voltage of the vehicle battery 12, and R is the standard resistance value of the flow rate control valve 6.

As a result, the switching element 16 illustrated in FIG. 2 is turned on at a predetermined repetition frequency T, but its ON time period (conduction time) is a time period corresponding to dcyc (%) within the repetition frequency T, and during the time period, the flow rate control valve 6 is energized.

Note that, when the ignition switch 11 is turned on, setting the initial value of the integral value to "1" means energizing the flow rate control valve 6 with the target current iset at the time at which the flow rate control valve 6 starts being energized.

Namely, as when the ignition switch 11 is turned on, the actual current iAct is zero, the integral value at this point of time is I(0+1)=I(0)+K(iset−iAct)=I(0) based on the Expression 1, in which n=0.

This means that the output of "Integ" in the above-described FIG. 2 is I(0), namely, "1", and as a result, the duty ratio dcyc % is calculated as a duty ratio to energize the flow rate control valve 6 with the target current iset.

Therefore, in the embodiment of the invention, the initial value of the integral value is set to a value that is required to set the current to the target current iset at the time at which energization of the flow rate control valve 6 is started.

Figure 5:
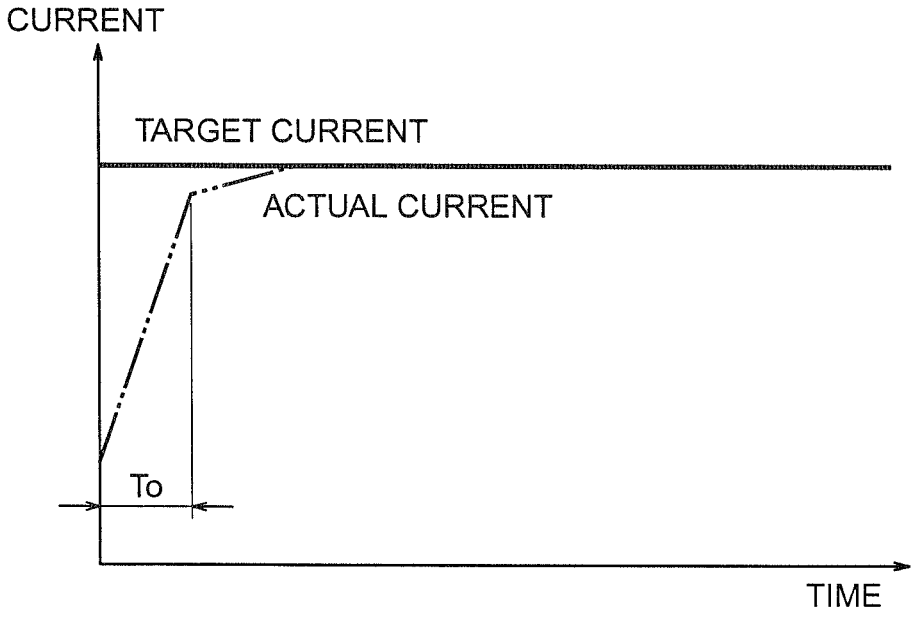

In this way, by setting a larger value K=K2 (the second integral gain) than that of normal conditions (K=K1(the first integral gain)) as the integral gain K in the integral processing that is part of the arithmetic processing of the energization duty ratio of the flow rate control valve 6 during the predetermined time period To after the ignition switch 11 is turned on, as shown in FIG. 5, in contrast to known art, the actual current of the flow rate control valve 6 (refer to the line with alternating long and two short dashes in FIG. 5) comes closer to the target current (refer to a solid characteristic line in FIG. 5) at an early point.

Further, when the vehicle is started, namely, when the ignition switch 11 is turned on, even if the fuel temperature and the temperature of the flow rate control valve 6 are substantially different, by setting the initial value of the integral value to a predetermined value to supply the target current, in contrast to known art, it becomes possible to avoid setting an inappropriate integral value as an initial value. In conjunction with setting the integral gain as described above, it becomes possible to shorten a stabilization time period of the integral value, and to supply appropriate energization to the flow rate control valve 6.

Note that, because the value that is appropriate for the predetermined time period To differs depending on operating conditions etc. of each common rail type fuel injection control apparatus, it is preferable to set the value based on a simulation, a test etc., while taking into account specific operating conditions etc.

Note that, in the above-described example structure, the integral gain is set to the second integral gain K2 during the predetermined time period after the ignition switch 11 is turned on, and the integral gain is switched to the first integral gain K1 immediately after the predetermined time period elapses. However, instead of switching the integral gain immediately in this way, for example, the integral gain can change from K1 to K2 linearly as time elapses, as illustrated by a characteristic line that is shown by the reference numeral G1 in FIG. 4 and that depicts the change in the integral gain. Further, it is also preferable that the integral gain gradually changes from K1 to K2 inversely proportionally, as illustrated by a characteristic line that is shown by the reference numeral G2 in FIG. 4 and that depicts the change in the integral gain. However, in either case, it needs to be within a range that does not cause deterioration in the stability or the responsiveness of the rail pressure control.

The invention can be applied to a common rail type fuel injection control apparatus that requires further improvement of stability and responsiveness of a rail pressure control, because it is structured such that switching of an integral gain in integral processing is performed for an energization current of a flow rate control valve, which controls an amount of fuel supply to a high pressure pump included in the common rail type fuel injection control apparatus, to reach a target current at an early timing, when a vehicle is started.

According to the invention, when the flow rate control valve starts being energized after the ignition switch is turned on, a value required to supply the target current to the flow rate control valve is set as the initial value of the integral value, and a larger value than that used under normal conditions is set as the integral gain during the predetermined time period after the ignition switch is turned on, while the integral value is returned to a normal value after the predetermined time period elapses. Therefore, the invention makes it possible for the energization current of the flow rate control valve to be appropriately controlled, and as a result, stability and responsiveness of the rail pressure control to be improved, without changing the basic control method in the known art that uses the fuel temperature to estimate the resistance value of the flow rate control valve, and even when it is unreasonable to assume that the fuel temperature matches the temperature of the flow rate control valve.

What is claimed is:

1. A drive control method of a flow rate control valve in a common rail type fuel injection control apparatus, comprising the steps of:

using an integral value of a difference between a target current and an actual current in feedback control of an energization current of the flow rate control valve such that an actual current of the flow rate control valve becomes closer to the target current, the flow rate control valve controlling an amount of fuel supplied to a high pressure pump that pressure feeds high pressure fuel to a common rail;

when an ignition switch is turned on, setting an initial value in an integral calculation that calculates an integral value of the difference between the target current and the actual current to a predetermined value to supply the target current at that time point to the flow rate control valve; and setting a second integral gain that is larger than a first integral gain that is used under normal conditions as an integral gain in the integral calculation during a predetermined time period after the ignition switch is turned on, while setting the first integral gain as the integral gain after the predetermined time period elapses.

2. The drive control method of the flow rate control valve in the common rail type fuel injection control apparatus according to claim 1, wherein in the integral calculation, every time the difference between the target current and the actual current is calculated, the difference is multiplied by the integral gain, and an integration result of a multiplication result is used as an integral value.

3. A common rail type fuel injection control apparatus comprising:

a high pressure pump that pressure feeds fuel to a common rail;

a flow rate control valve that controls an amount of fuel supply to the high pressure pump; and an electronic control unit which uses an integral value of a difference between a target current and an actual current of the flow rate control valve in feedback control of the flow rate control valve such that the actual current of the flow rate control valve becomes closer to the target current, the electronic control unit being structured such that when an ignition switch is turned on, an initial value in an integral calculation that calculates the integral value of the difference between the target current and the actual current is set to a predetermined value to supply the target current at that time point to the flow rate control valve, and a second integral gain that is larger than a first integral gain, which is used under normal conditions, is set as an integral gain in the integral calculation during a predetermined time period after the ignition switch is turned on, while the first integral gain is set as the integral gain and the integral calculation is performed after the predetermined time period elapses.

4. The common rail type fuel injection control apparatus according to claim 3, wherein in the integral calculation, every time the difference between the target current and the actual current is calculated, the difference is multiplied by the integral gain, and an integration result of a multiplication result is used as an integral value.

* * * * *